US006113037A

United States Patent [19]

Pace

[11] Patent Number: 6,113,037

[45] Date of Patent: Sep. 5, 2000

[54] RAILROAD MAINTENANCE-OF-WAY PERSONNEL WARNING SYSTEM APPARATUS AND METHOD THEREFOR

[75] Inventor: Joseph A. Pace, Omaha, Nebr.

[73] Assignee: EVA Signal Corporation, Omaha, Nebr.

[21] Appl. No.: 09/084,863

[22] Filed: May 26, 1998

Related U.S. Application Data

[63] Continuation-in-part of application No. 08/601,902, Feb. 15, 1996, abandoned, which is a continuation-in-part of application No. 07/650,303, Feb. 4, 1991, abandoned

[60] Provisional application No. 60/009,857, Jan. 12, 1996.

[51] Int. Cl.[7] ..... B61L 25/00

[52] U.S. Cl. ..... 246/124; 246/477; 246/488; 246/292; 246/167 A

[58] Field of Search ..... 246/124, 167 R, 246/477, 483, 167 A, 125, 126, 202, 270 R, 292, 294, 295, 473 R, 473.1; 340/933, 941

[56] References Cited

U.S. PATENT DOCUMENTS

| | | | |
|---|---|---|---|
| 1,700,933 | 2/1929 | Gurden . | |
| 1,797,302 | 3/1931 | Vantassel . | |
| 1,809,374 | 6/1931 | Carter . | |
| 1,812,183 | 6/1931 | Vantassel et al. . | |
| 1,868,489 | 7/1932 | Barry . | |
| 1,915,696 | 6/1933 | Richterkessing et al. . | |
| 2,203,988 | 6/1940 | Griswold | 177/329 |
| 2,221,290 | 11/1940 | Slawson | 40/133 |
| 2,592,163 | 4/1952 | Madden | 246/125 |
| 3,035,167 | 5/1962 | Luft et al. | 246/130 |
| 3,178,683 | 4/1965 | Phelps | 340/31 |
| 3,267,281 | 8/1966 | Buck | 246/125 |
| 3,558,874 | 1/1971 | Freehafer | 246/126 |
| 3,781,543 | 12/1973 | Staples et al. | 246/130 |
| 3,927,852 | 12/1975 | Sibley | 246/126 |
| 3,963,202 | 6/1976 | Hopkins | 246/125 |
| 4,108,405 | 8/1978 | Gibson | 246/125 |
| 4,122,523 | 10/1978 | Morse et al. | 364/436 |
| 4,307,860 | 12/1981 | Kuhn | 246/128 |
| 4,449,115 | 5/1984 | Koerner | 340/941 |
| 4,581,700 | 4/1986 | Farnham et al. | 364/185 |
| 4,613,103 | 9/1986 | Waranowitz | 246/473 A |
| 4,754,272 | 6/1988 | Illenberg et al. | 340/815.1 |
| 4,895,325 | 1/1990 | LeVoir | 246/473.1 |
| 4,942,395 | 7/1990 | Ferrari et al. | 340/907 |
| 5,252,893 | 10/1993 | Chacham et al. | 315/200 |
| 5,628,479 | 5/1997 | Ballinger | 246/249 |
| 5,727,758 | 3/1998 | Penza et al. | 246/124 |
| 5,735,491 | 4/1998 | Atkinson | 246/124 |
| 5,735,492 | 4/1998 | Pace | 246/125 |
| 5,757,288 | 5/1998 | Dixon et al. | 340/941 |
| 5,924,651 | 7/1999 | Penza et al. | 246/124 |

FOREIGN PATENT DOCUMENTS

| | | |
|---|---|---|
| 2 233 667 | 6/1973 | France . |
| 24 05 408 | 8/1975 | Germany . |
| 40 05 354 | 8/1991 | Germany . |
| 42 19 067 | 12/1993 | Germany . |
| 2-60881 | 3/1990 | Japan . |
| 3-159869 | 7/1991 | Japan . |
| 4-221271 | 8/1992 | Japan . |
| 92/04699 | 3/1992 | WIPO . |

*Primary Examiner*—Mark T. Le
*Attorney, Agent, or Firm*—Suiter & Associates PC

[57] ABSTRACT

A railroad maintenance-of-way personnel warning system and method therefor provides advanced detection and warning of oncoming trains encroaching the construction area. Magnetometer sensors detect an oncoming train whereby a waning signal is transmitted to a receiver unit at the construction zone. Warning alarms including a flashing light and siren horn are thereby activated to indicate the imminent danger such whereupon the construction personnel may take precautionary and evasive action in sufficient time to avoid mishap.

16 Claims, 5 Drawing Sheets

RAILROAD MAINTENANCE-OF-WAY PERSONNEL WARNING SYSTEM APPARATUS AND METHOD THEREFOR

CROSS REFERENCE TO RELATED APPLICATION

The present application is a continuation-in-part of U.S. application Ser. No. 08/601,902 filed Feb. 15, 1996 (now abandoned) which is a continuation-in-part of U.S. application Ser. No. 07/650,303 filed Feb. 4, 1991 (abandoned). Said U.S. application Ser. No. 08/601,902 claims the benefit under 35 U.S.C. §119 of U.S. Provisional Application Ser. No. 60/009,857 filed Jan. 12, 1996. U.S. application Ser. No. 08/601,902 and U.S. Provisional Application Ser. No. 60/009,857 are herein incorporated by reference in their entirety.

TECHNICAL FIELD

The present invention relates generally to railroad warning systems and specifically to a warning system for railroad maintenance-of-way personnel working on or in the vicinity of active railroad tracks.

BACKGROUND OF THE INVENTION

Railroad crews working on or in the vicinity of active railroad tracks are susceptible to accidents as a result of not being sufficiently warned of an oncoming train entering the work area. The rail work is typically performed in isolated regions away from crossing areas, and therefore the work crews do not have the benefit of standard crossing signals to warn them of approaching trains. Thus, there lies a need for a reliable warning system for warning maintenance-of-way crews which allows the crew to concentrate on the work at hand while providing adequate warning of oncoming train hazards in order to clear the tracks of tools, equipment and workers to avoid an accident. The railroad crew warning system is further required to be portable and easily set up by the crew in a relatively short period of time. Additionally, the warning system should be of sufficient operational efficiency to activate the warning system only upon the detection of a train to thereby mitigate the natural human tendency to ignore the warning system after false activations.

SUMMARY OF THE INVENTION

The present invention provides a system for warning railroad crews working on or in the vicinity of railroad tracks of oncoming trains. A train detector probe is placed near the train rails at a predetermined distance from the works crew in either direction along the tracks. Electronic detection, processing and control circuitry receive and process the detector probe signal which is transmitted via a radio frequency communications link to a receiver in the located vicinity of the crew. The receiver processes the received train detection signal and thereupon activates a warning system which provides visual and audio warning to the crew of the presence of an incoming train.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION OF AN EXEMPLARY EMBODIMENT

Reference will now be made in detail to the presently preferred embodiment of the invention, an example of which is illustrated in the accompanying drawings.

Figure 1:
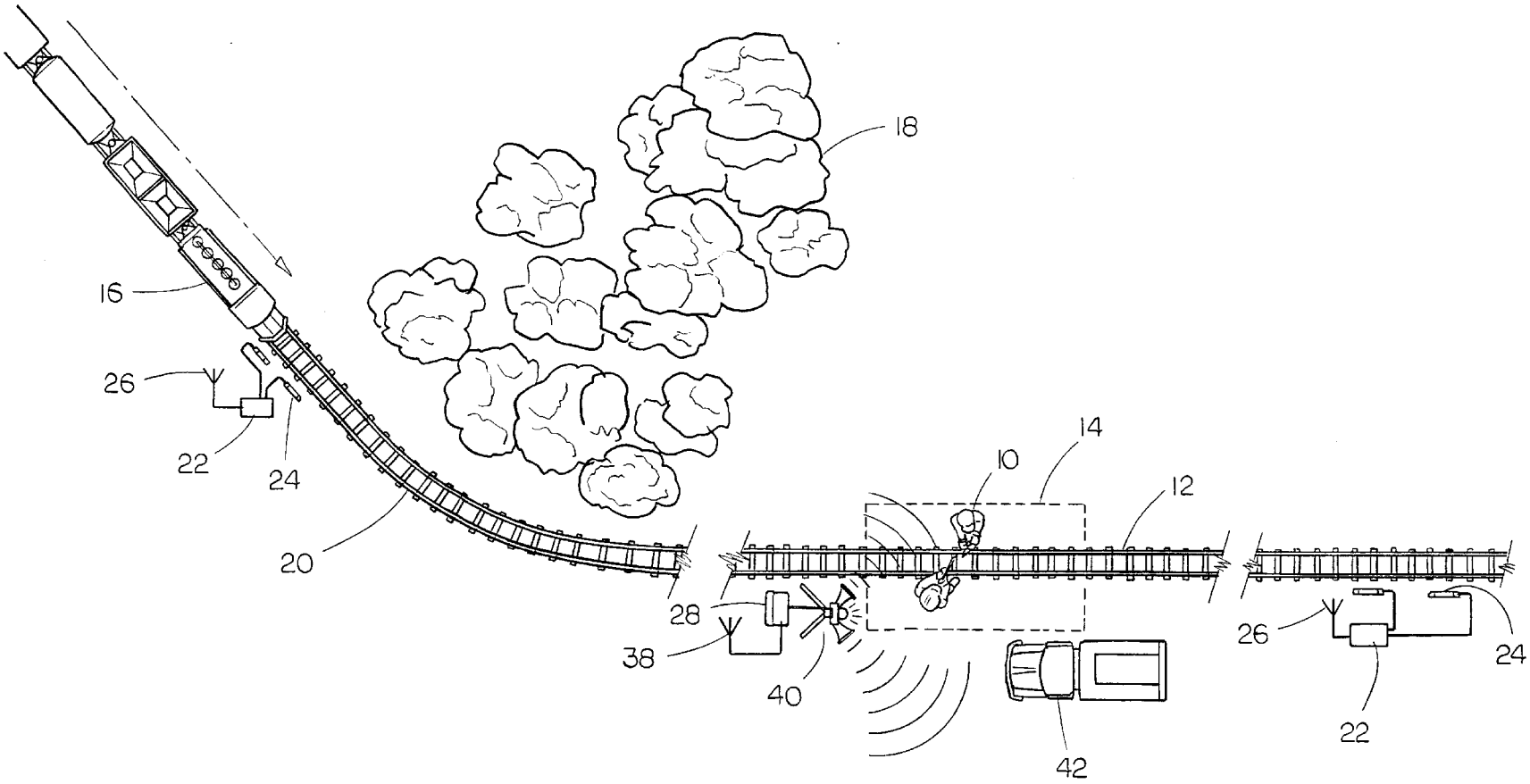
FIG. 1 is a top plan view of a typical application of the present invention.

FIG. 1 illustrates a typical application of the present invention. A maintenance-of-way crew 10 is required to work on a length of active railroad track 12 in an area defining a construction zone 14. The maintenance-way-crew 10 provides necessary upkeep and maintenance of the railroad tracks 12 which may be active, meaning that the tracks 12 are in use by trains while construction is being performed. The possibility of an oncoming train 16 poses a serious safety hazard to the crew 10 working on the track 12 who must concentrate on the construction work to be performed while constantly being alert to the possible oncoming train 16. Often the topography of the land and nearby flora and fauna prevent the workers 10 from becoming aware of the oncoming train hazard 16 to sufficiently move themselves and their equipment to a position of safety before the arrival of the train 16. Thus, the combination of the terrain, flora and fauna, such as a clustering of trees 18, and the layout of the track 12, such as bend 20, may combine to block the view and sounds of an oncoming thereby increasing the safety hazard to the maintenance-of-way crew 10. The present invention provides a system to detect an oncoming train 16 to provide adequate warning of the railroad construction crew 10 to maneuver to a position of safety in time to avoid an accident.

As can be seen from FIG. 1, a remote sensor unit 22 is placed at a predetermined distance (e.g., one or two miles) in either or both directions along tracks 12. Each sensor unit 22 includes two sensor probes 24 which are capable of detecting the presence of a train 16. The sensor probes 24 are preferably responsive to local disturbances of an electromagnetic field, such as the disturbance of the magnetic field of the earth caused by the passing of the train 16, a large metallic object.

In response to the passing train 16, the sensor probes 24 send a detection signal to the sensor unit 22 which contains the necessary processing electronics to process the detection signal of the sensor probes 24. The sensor unit 22 includes signal transmission means (e.g., a radio frequency (RF) transceiver or transmitter with an antenna 26) to transmit the train detection signal to a base receiver unit 28. The receiver unit 28 is located in the vicinity of the construction zone 14 and the workers 10, and includes signal receiving means which preferably includes an antenna 38 and a radio frequency transceiver or receiver. The receiver unit 28 includes processing electronics necessary to receive and process train detection signals received from the sensor unit 22. A crew warning device 40 is coupled to the receiver unit 28 to visually and audibly alert and warn the crew 10 that an oncoming train 16 has been detected. Upon being alerted by the crew warning device 40, the construction crew 10 may move to a safe position until the train 16 has passed, whereupon the crew 10 may resume working. The sensitivity of the sensor probes 24 may be optimally adjusted such that only the mass of a train 16 will trigger the warning system and that other vehicles such as a truck 42 will not cause false alarms which degrade the confidence of the workers 10 in the integrity of the warning system.

Figure 2:
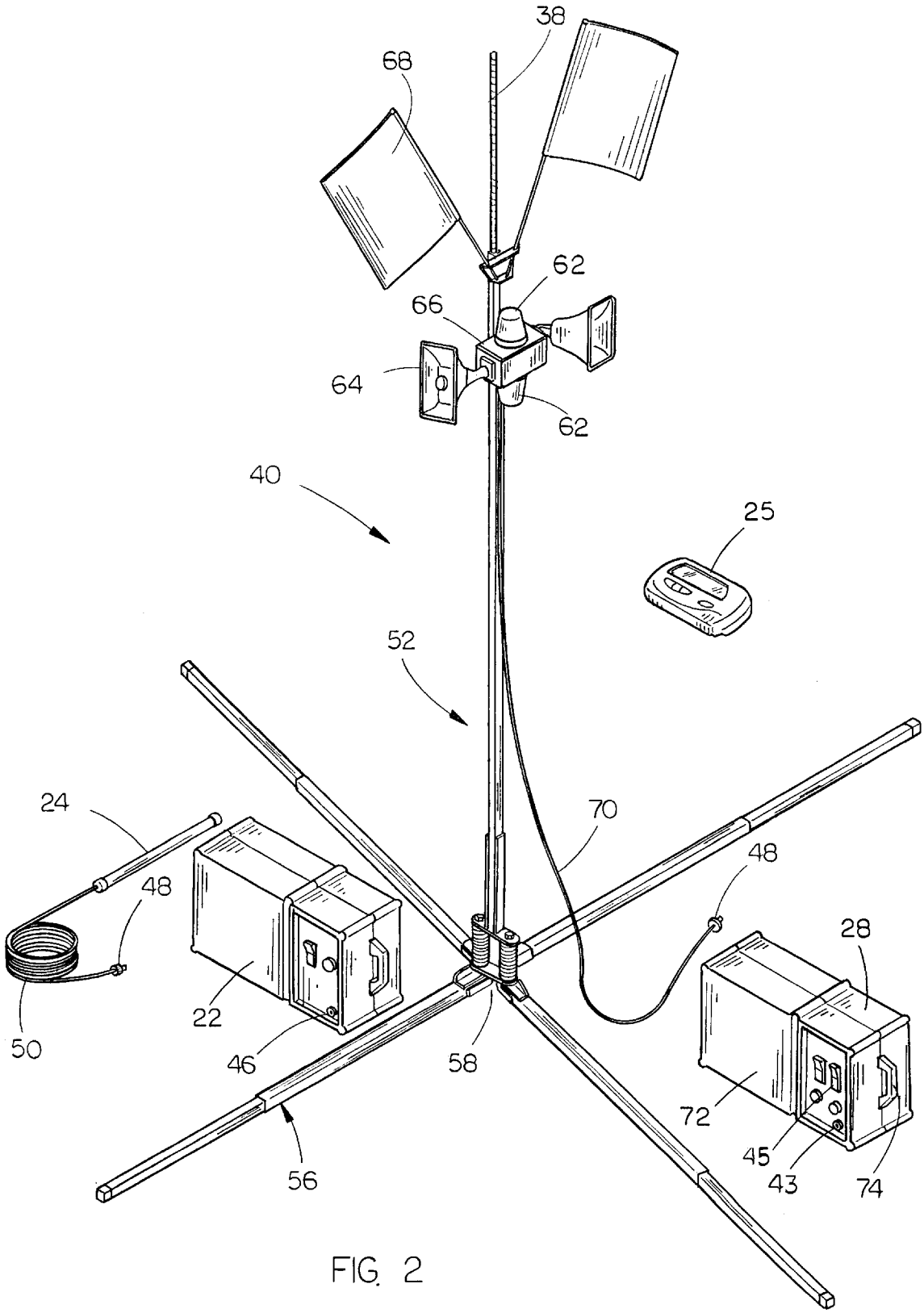
FIG. 2 is a perspective view of the basic components of a preferred embodiment of the present invention.
Figure 4:
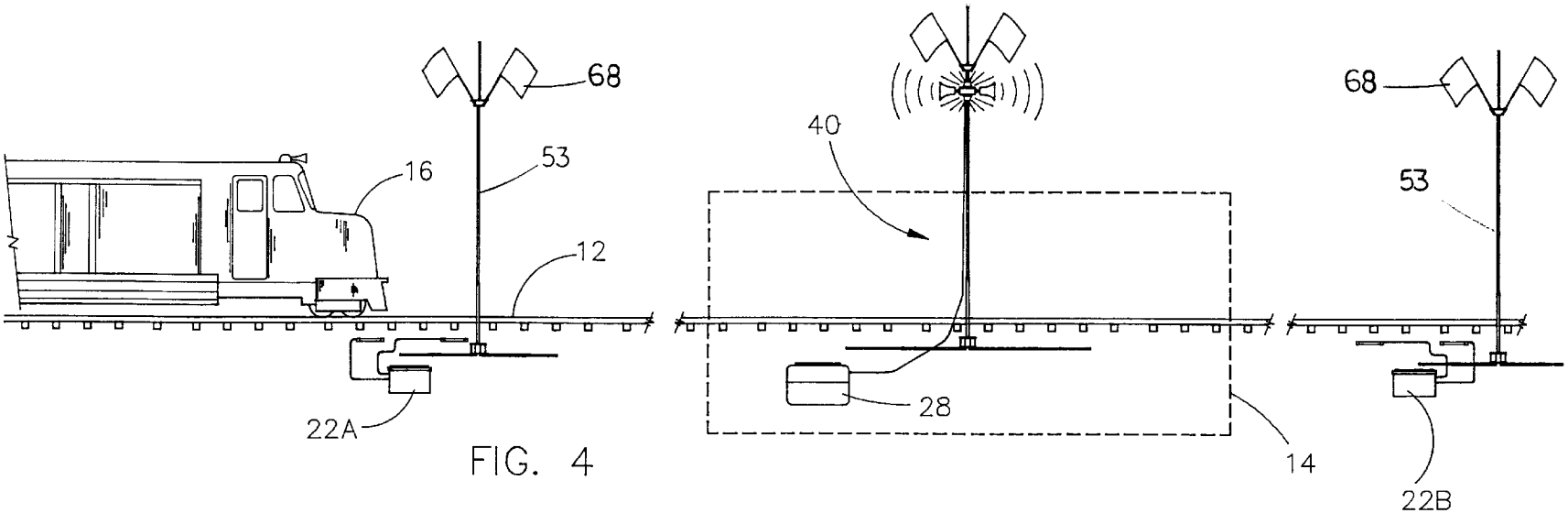
FIG. 4 is an elevation view of the present invention further showing typical activation thereof.
Figure 5:
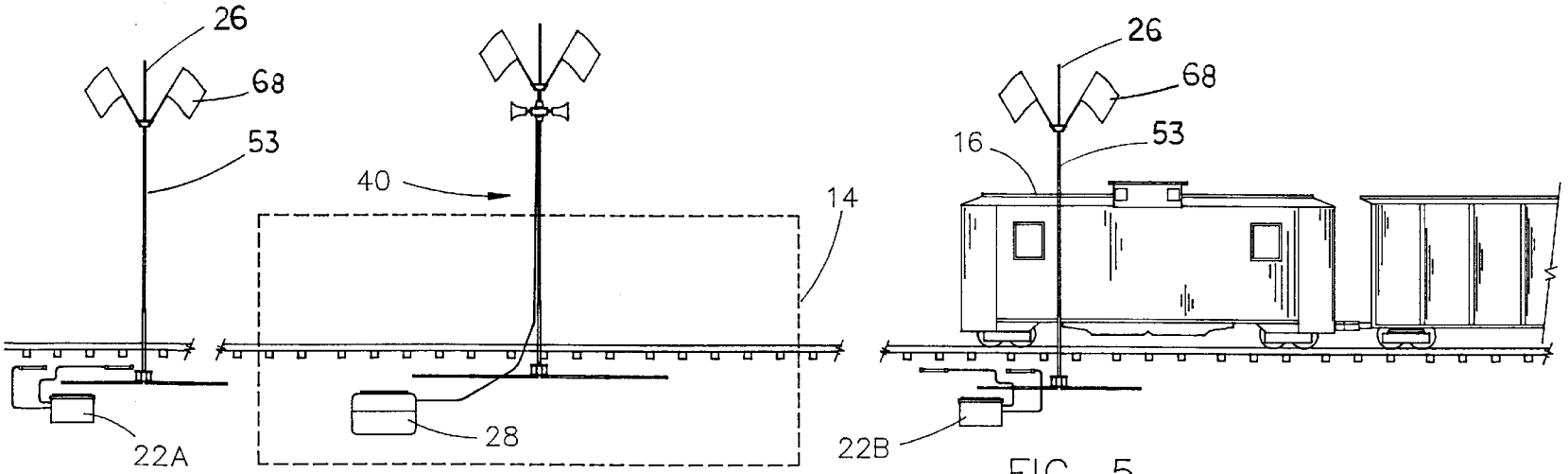
FIG. 5 is an elevation view of the present invention further showing typical deactivation thereof.

FIG. 2 illustrates the main components of the present invention. Sensor unit 22 preferably comprises a light weight and durable plastic, fiberglass or steel weatherproof housing which contains sensing, processing and control electronics. The sensor unit 22 preferably includes a power supply which provides power to the electronic sensing circuitry contained within the sensor unit 22. The power supply may be, for example, a rechargeable battery contained within the housing of the sensor unit 22. A solar panel array (not shown) may be provided to maintain a charge on the power supply. The sensor unit 22 includes receiving jacks 46 for receiving a plug 48 at the end of sensor probe 24. The sensor probe plug 48 connects to a receiving jack 46 of the sensor unit 22 via a length of probe cabling 50. The length of the probe cabling 50 is sufficiently long to allow the positioning of the sensor probe 24 near the railroad track 12 while allowing for the positioning the sensor unit 22 in an optimal position to communicate (e.g., transmit and receive signals) with the receiver unit 28. As shown in FIGS. 4 and 5, portable standards 53 having safety flags 68 (preferably of bright safety orange color) may be erected near each remote sensor unit 22A and 22B to warn the operator of the oncoming train that his train is approaching a construction zone. These standards 53 may support the antennas 26 which are coupled to the remote sensor units 22A and 22B.

Returning now to FIG. 2, the crew warning device 40 includes a portable light standard 52 which may be erected near the construction zone 14 (see FIG. 1). The light standard 52 preferably includes telescopic legs 56 which extend from and are hinged at a spring resistance hinge 58 making the light standard 52 readily collapsible and capable of being placed upon uneven terrain while remaining sturdily in place. The light standard 52 preferably includes four legs but may alternatively use three legs as well. Erected vertically from spring hinge 58 is a mounting shaft 60 upon which are mounted visual warning means 62 and audio warning means 64. The visual warning means is preferably two L.O.S. beacons mounted on the mounting shaft such that the light emitted therefrom sweeps horizontally in order to cover a maximum area which includes the construction zone 14. The beacons may be Commander Strobe Beacons, Model 5200 manufactured by Whelen Engineering Co. of Chester, Conn., the beacons using a xenon flash bulb. The audio warning means 64 preferably includes two warning siren horns capable of emitting a high decibel warning sound that can be heard over the noise of construction activity. The beacons 62 and horns 64 are mounted to a mounting unit 66 which is in turn mounted to the mounting shaft 60. Two safety flags 68 of bright safety orange color are mounted at the top end of the mounting shaft 60 to generally alert others that construction activity is occurring in the vicinity. An omindirectional antenna 38 is mounted on the shaft 52 and connected to the receiver unit 28.

The warning system may also include one or more portable warning devices 25 which may be carried by individual crew members 10 or mounted to equipment or construction vehicles such as truck 42. The portable warning device 25 allows crew members who are operating or working near machinery which produces excessive noise to be warned when on oncoming train is detected. Operation (i.e., activation and deactivation) of the portable warning device 25 is controlled by the receiver unit 28 via radio frequency (RF) communication so that the device 25 may be remotely activated to warn the crew member of the oncoming train (e.g., the portable warning device 25 may be activated when the crew warning device 40 is activated). The portable warning device 25 may include visual and audible warning means such as an Light Emitting Diode (LED) display and a small horn or speaker for alerting the crew member that a train has been detected. Alternatively, the system may automatically shut down or turn off equipment being operated by crew members when a train is detected so that the crew warning device 40 may be seen or heard.

The antenna 38, beacons 62 and horns 64 are connected to the receiver unit 28 via a receiver cable 70 which connects to a jack 43 with a plug 48 at the end of the cable 70. The receiver unit 28 is generally of the same or similar construction as the sensor unit 22 in that it is constructed of a light weight plastic, fiberglass or steel material and is weatherproof. The receiver unit 28 may be constructed having a cover assembly 72 which may be opened to replace the battery or repair the unit's internal electronics. A solar panel array may be mounted to the cover 72 of the receiver unit 28 or may be separately mounted. The receiver unit 28 also includes a control panel having basic operational controls (e.g., on-off switch, reset switch, etc.). The receiver unit may also include a handle 74 for ease of portability.

Figure 3:
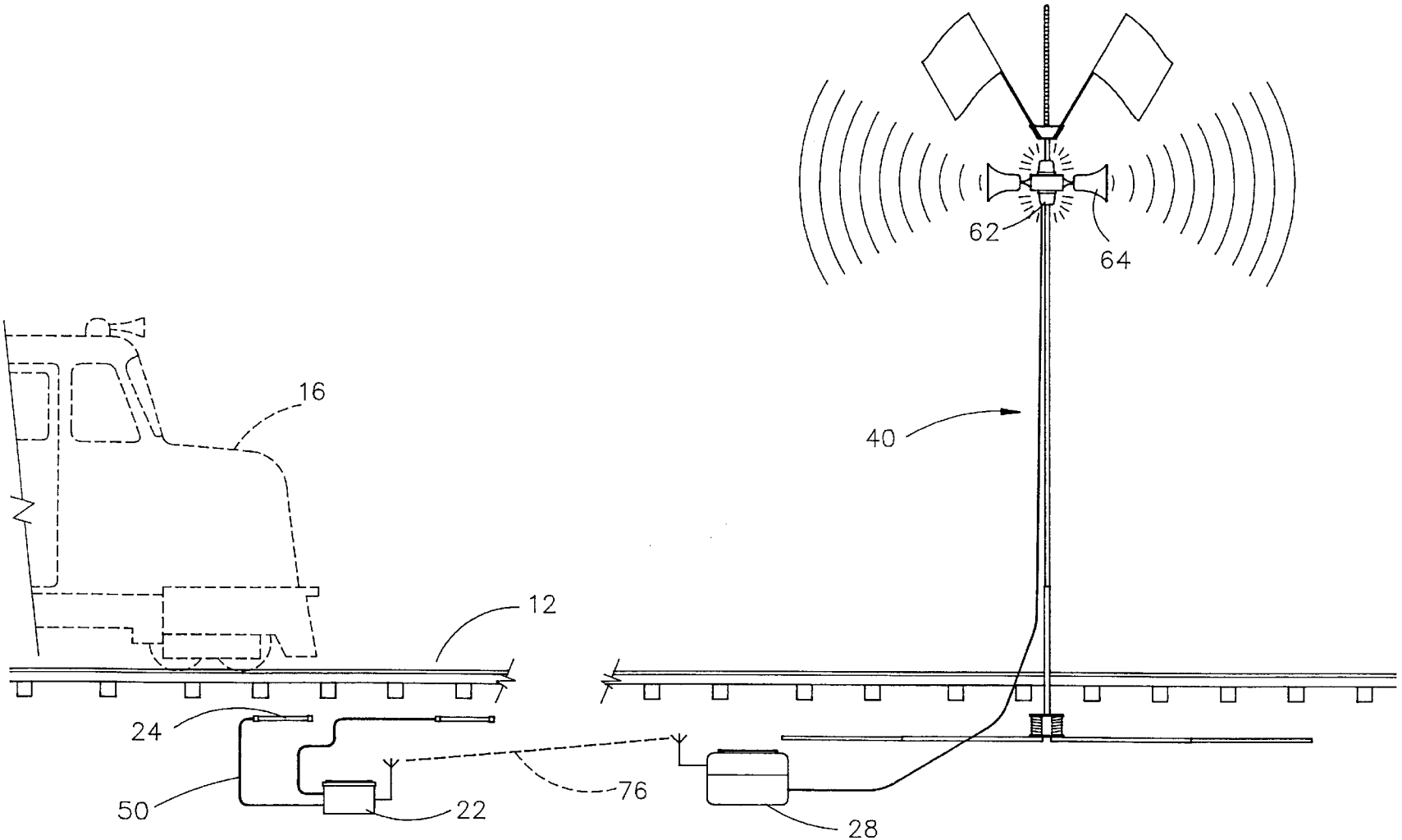
FIG. 3 is an elevation view of the present invention showing typical operation thereof.

FIG. 3 depicts the operation of the present invention in detecting the presence of an oncoming train. The receiver unit 22 is placed up the tracks 12 from the construction zone 14 at a predetermined distance therefrom. In a preferred embodiment of the present invention the receiver unit 22 is placed approximately one mile from the construction zone 14 which provides approximately one minute warning time to the crew 10 for average train speeds of sixty miles per hour.

The sensor probes 24 are placed alongside the train tracks 12 parallel thereto. Only one probe 24 is required to sense a train 16, but preferably two probes 24 are utilized for redundancy in case of failure of one of the probes. Further, the utilization of two probes provides both information as to the direction and speed of the oncoming train. In an alternative embodiment of the present invention, two sensor probes 24 may be utilized to detect the direction and speed of an oncoming train 16. Further, it has been found that the sensor probes 24 are directionally sensitive in that the probes 24 exhibit greater sensitivity at the end of the probe 24 connected to the probe cable 50. Preferably, the probes 24 are laid alongside the tracks 12 with the end of the probe 24 connected to the cabling 24 pointing toward the direction from which the oncoming train 16 will approach and the free end of the probe 24 pointing toward the construction zone 14.

A moving oncoming train 16 induces current in the sensor probe 24 upon the train passing by the probe 24. The induced signal from the train 16 is detected by the electronic circuitry of the receiver unit 22 and transmitted to the receiver unit 28 which is located at the construction zone 14. The sensor unit 22 and the receiver unit 28 are couple via a radio frequency communications link 76. The receiver unit 28 receives the transmitted detection signal from the sensor unit 22 and thereupon activates the crew warning device 40 which is placed in the vicinity of the construction zone 12. The beacon and the horns are thereby activated, visually and audibly alerting the crew 10 to the presence of the oncoming train 16.

FIGS. 4 and 5 illustrate the operation of an embodiment of the present invention in which two sensor units are utilized. A first sensor unit 22A and a second sensor unit 22B each placed in either direction down the tracks 12 form the construction zone 14. As shown in FIG. 4, an incoming train 16 passing by sensor unit 22A activates the crew warning device 40 whereupon the crew 10 may take precautionary action.

As shown in FIG. 5, sensor unit 22B will be activated as the train 16 exits the construction zone 14 and passes sensor unit 22B further long down the tracks 12. When the train 16 has completely passed by sensor unit 22A, sensor unit 22A stops transmitting the train detection signal to the receiver unit. The sensor unit 22B will send a detection signal to the receiver unit 28 upon the passing of the train 16. The receiving of a detection signal from down track receiver unit 22B indicates and verifies the passing of the train whereupon the receiver unit may initiate automatic deactivation of the crew warning device 40.

The warning system is thereby automatically reset and ready to detect the next incoming train. Logic processors included with the electronic circuitry of the receiver unit are capable of processing the presence, absence, sequence and timing of the detection signals from sensor unites 22A and 22B, activating the crew warning device 40 when a train 16 is incoming and deactivating the crew warning device 40 when the train 16 has passed and then resetting the system. A manual reset switch 45 is also provided (see FIG. 1).

Figure 6:
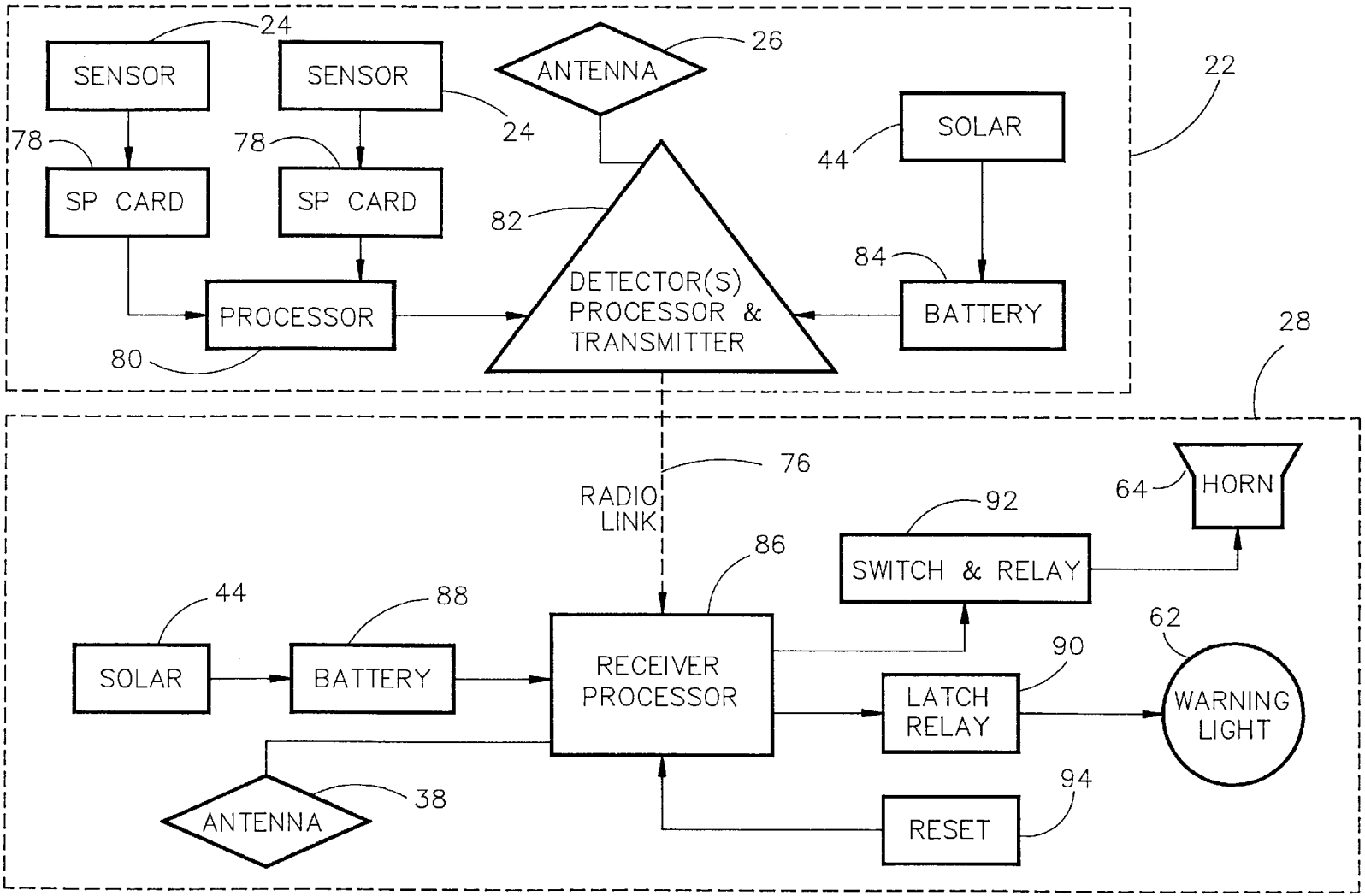
FIG. 6 is a schematic diagram of the present invention showing the operational features thereof.

FIG. 6 illustrates schematically the electronic components of the present invention. The sensor probes ("SENSOR") 24 connect to sensor unit 22 and are coupled to sensor processor cards ("SP CARD") 78. The sensor processor cards 78 interface with electronic processing means ("PROCESSOR") 80 and include electronic circuitry to act as a buffer between the sensor probes 24 and the processing means 80.

In a preferred embodiment of the present invention, the sensor probes 24 comprise an inductor coil winding having a powdered iron core or other similar paramagnetic material. The sensors probes detect variations in the magnetic field of the earth when a train passes nearby by detecting the resulting change of permeability of the space surrounding the inductor coil. A moving train passing by the sensor probe 24 alters the magnetic flux lines of the earth's magnetic field through the inductor coil of the probes 24 thereby inducing a current in the inductor coil of the sensors 24 which is detected, received and amplified by the sensor processor cards 78. Thus, sensor probes 24 provide an electrical output signal in response to local variance in the magnetic field of the earth caused by a passing train. The sensors function similarly to musical instrument pickups with the magnetic field of the earth acting as the permanent magnet and the train acting as the vibrating strings.

The sensor probes 24 are preferably Cartel CT-6 magnetometer probes available from Preferred Technology Group of Lancaster, Pa. or similar thereto. The sensor processor cards 78 include magnetometer control circuits also manufactured by Preferred Technology Group available as CT-2B circuit board subassemblies. The sensor processor cards 78 preferably include a voltage spike protector clamp across the probe input terminals 46 to protect the circuitry from environmental voltage spikes caused by lightning, for example. The sensitivity of sensor probes 24 may be adjusted with the sensor processor cards 78. The sensitivity of the sensor probes 24 is preferably optimally adjusted to detect trains without being triggered by other types of vehicles (e.g., cars, trucks, etc.).

The processor means 80 connects with a detector processor and transmitter ("DETECTOR(S) PROCESSOR & TRANSMITTER") 82 which includes communications means (e.g., a transceiver or transmitter) for communicating with the receiving unit 28 via an antenna ("ANTENNA") 26. As shown in FIGS. 4 and 5, the antenna 26 may be externally mounted to portable standard 53 so that it is elevated above the ground (and other obstructions) to improve transmission and reception of signals. The sensor unit 22 preferably receives operational power from a battery ("BATTERY") 84 (and optionally solar panel array ("SOLAR") 44). The battery 84 is preferably a rechargeable lead acid type battery designed to operate in extreme environmental conditions. Alternatively, the rechargeable battery 84 may comprise other various types of rechargeable electrochemical cells such as alkaline, nickel-cadmium, nickel-metal hydride, sealed lead-acid, zinc-air or lithium ion cells or the like, for example.

The solar panel array 44 may be utilized to provide electrical energy converted from solar energy to charge the battery 84 and to provide a trickle charge thereto to keep the battery 84 topped off. Additionally, the solar panel array 44 may be utilized to provide supplemental operational power to the sensor unit 22 in case of depletion of the battery charge or battery failure, for example. A similar battery ("BATTERY") 88 (and solar panel array ("SOLAR") 44) may provide operational power to the receiver unit 28. The battery 88 is preferably a sealed, rechargeable lead-acid type battery manufactured by GNB Industrial Battery Company of Saint Louis, Mo. as the "ABSOLYTE" product which is designed for solar service and railroad equipment applications. The battery 84 preferably includes a battery charging regulator model ASC 12/2 available from Siemens Solar Inc. of Camarillo, Calif. The solar panel 44 is a model M75 available also available form Siemens.

Upon the detection of an oncoming train 16, the transmitter 82 transmits a signal via a radio frequency communications link ("RADIO LINK") 76 to a receiver ("RECEIVER PROCESSOR") 86 contained within the receiver unit 28. Antennas ("ANTENNA") 26 and 82 are provided for the transmitter processor 82 and the receiver processor 86 respectively to increase the signal gain of the radio communications link 76. The radio communications link 76 preferably utilizes a band of 8 spread spectrum channels at a frequency licensed by the Federal Communications Commission for such type of radio frequency communications. The radio frequency communications between the sensor unit 22 and the receiver unit 28 is preferably dual-tone multiple frequency (DTMF) encoded, spread spectrum modulated transmission to avoid unintended jamming or interference from other radio frequency sources operating in the vicinity thereby preventing loss of communication or false alarms. The processors (80, 82, 86) of the present invention are preferably implemented in RTC31/52 computer board assemblies as manufactured by Micromint Inc. of Vernon, Conn.

In the event that a train encroaches the vicinity of the sensor unit 22, the sensor probes 24 detect the presence of the train and send a detection signal received by the sensor probe cards 78 of the receiver unit 22. The sensor probe cards 78 send a signal to the processor 80 in response to the detection signal received from the sensor probes 24. The processor 80 activates the detector transmitter 82 to commence transmission of a coded warning signal to the receiver 86 of the receiver unit 28. The receiver 86 receives and decodes the transmitted warning signal whereupon a latch relay ("LATCH RELAY") 90 is triggered to activate visual warning means ("WARNING LIGHT") 62. Further, a switch and relay ("SWITCH & RELAY") 92 is triggered thereby activating audible warning means ("HORN") 64. The visual and audible warning means (62, 64) alert the workers of the approaching train so that they may take the necessary evasive actions to stop work and to move themselves and any equipment to safety.

After the train 16 has passed, a manual reset switch ("RESET") 94 may be engaged by the workers to reset the latch relay 90 and the switch and relay 92, thereby turning off the visual and audible warning means (62, 64) warning and resetting the warning system for the next train detection event. Alternatively, the warning system may be programmed to automatically rest upon passing of the train as it is sensed passing a second sensor unit 22.

An important feature of the present invention is a handshaking communications protocol between the sensor unit 22 and the receiver unit 28. The base or receiver unit 28 preferably transmits a test signal at periodic intervals (e.g., every 5 seconds, every 60 seconds, every 150 seconds, etc.) to the remote sensor unit 22. The remote sensor unit 22 receives this signal and responds by transmitting a return signal (e.g., and "All Clear" or "I'm OK" signal) indicating that the remote sensor unit 22 is functioning properly. The successful transmission and reception of these signals by the receiver unit 28 and sensor unit 22 verifies the proper functioning of the crew warning system. If the all clear call signal is not received after a predetermined number of attempts (e.g., the receiver unit 28 transmits a number of, for example three, test signals and receives no response from the sensor unit 22), the receiver unit 28 immediately enters into an alarm mode. In the alarm mode, a system fail warning light located on the control panel of the receiver unit 28 or other alarm may be activated to alert the workers that protection is no longer provided by the warning system. According to a preferred embodiment, the siren horn 64 may be capable of emitting two or more warning signals (i.e., a constant tone indicating failure of the system and a cyclical or "whelping" tone when a train is detected). This allows the crew members to readily distinguish between a failure of the system and the approach of a train. Failure of the sensor unit 22 to transmit the all clear signal may be caused by battery failure, component failure, unforeseen damage to the sensor unit 22, movement of a sensor unit 22 out of transmission range, or loss of integrity of the radio frequency communication link 76, for example.

In an alternative embodiment of the present invention, multiple sensor units 22 may be utilized in areas having multiple railroad tracks. Each sensor unit 22 is preferably capable of operating in conjunction with up to four sensor probes 22 simultaneously. Further, the receiver unit 28 is preferably designed to receive and process up to eight different transmission codes from eight individual sensor units 22 simultaneously. Utilization of multiple probes 24 and sensor units 22 is of particular utility in areas having several railroad track such as wyes, spurs, or switchyards, for example.

In an exemplary embodiment, the system may be used to alert two or more maintenance-of-way railroad crews working in a construction zone on adjacent sections of active railroad track to the presence of an oncoming train. Crew warning devices 40 (see FIG. 2) may be positioned near each maintenance-of-way crew for alerting the crew to the presence of an oncoming train on their respective section of track. Sensor probes 24 may be positioned adjacent to each section of active railroad track at a predetermined distance from the construction zone for detecting an oncoming train as it approaches the construction zone on one of the sections of track. A sensor unit 22 coupled to the sensor probe 24 receives the train detection signal and transmits a train indication signal which identifies the section of track on which the train is traveling. The radio frequency communications between the sensor unit 22 and the receiver unit 28 is preferably dual-tone multiple frequency (DTMF) encoded, spread spectrum modulated transmission allowing the senor unit 22 to transmit sufficient information to identify itself to the receiver unit 28. Thus, when the receiver unit 28 receives the train indication signal, it may activate the appropriate crew warning device 40 for the work crew working near the section of track on which the oncoming train is detected. In this manner, a first work crew may be warned of an approaching train so that they may take appropriate action while other crews working in the same area who are not in danger may continue working uninterrupted.

Additional embodiments of the present invention contemplate implementation of an event recorder for monitoring and recording train activity. The recorded event data may be utilized in analysis of accidents or close calls to determine event causation and to learn how the system may be improved if necessary. The event recorder may be implemented by additional programming of the microprocessors (80, 82, 86) of the present invention in conjunction with non-volatile electronic memory (e.g., NVRAM, EEPROM, FLASH RAM) or battery refreshed electronic memory (e.g., SRAM, DRAM) or other means for saving the event data (e.g., magnetic tape). The electronic memory is preferably a 64 kilobyte static random access memory chip (SRAM) backed by a lithium type battery. Other types of data may also be monitored and recorded such as battery charge condition, train speed, train length, direction of approach, etc.

It is believed that the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A system for alerting a maintenance-of-way railroad crew working in a construction zone on a section of an active railroad track to the presence of an oncoming train, the system comprising:

(a) a crew warning device for alerting the maintenance-of-way crew to the presence of the oncoming train;

(b) a first sensor probe positioned adjacent to the railroad track at a predetermined distance from the construction zone for detecting the train as it enters the construction zone and producing a first train detection signal in response thereto;

(c) a first sensor unit coupled the first sensor probe for receiving the first train detection signal and transmitting a first train indication signal thereupon;

(d) a second sensor probe positioned adjacent to the railroad track at a predetermined distance from the construction zone for detecting the presence of the train as it leaves the construction zone and producing a second train detection signal in response thereto;

(e) a second sensor unit coupled to the second sensor probe for receiving the second train detection signal and transmitting a second train indication signal thereupon;

(f) a receiver unit operatively coupled to the crew warning device, the receiver unit activating the crew warning device upon receiving the first train indication signal and deactivating the crew warning device upon receiving the second train indication signal.

2. The system of claim 1, wherein the first and second sensor probes comprise magnetometers.

3. The system of claim 1, wherein the first sensor unit comprises:

(a) a processor for processing the first train detection signal received from the first sensor probe and generating the first train indication signal in response thereto;

(b) a sensor interface for interfacing the first train detection signal of the first sensor probe with the processor;

(c) a transmitter for transmitting the first train indication signal; and (d) a power supply for supplying operational power to the first sensor unit.

4. The system of claim 3, wherein the first sensor unit comprises a solar panel array for providing a charge current to the power supply.

5. The system of claim 3, further comprising an antenna coupled to the transmitter for transmitting the first train indication signal.

6. The system of claim 1, wherein the receiver unit comprises:

(a) a receiver for receiving the first train indication signal from the first sensor unit and the second train indication signal received from the second sensor unit;

(b) a processor for processing the first train indication signal and the second train detection signal and activating or deactivating the crew warning device in response thereto; and (d) a power supply for supplying operational power to the processor.

7. The system of claim 6, wherein the receiver unit further comprises a solar panel array for providing a charge current to the power supply.

8. The system of claim 6, further comprising an antenna coupled to the receiver for receiving the first train indication signal and the second train indication signal.

9. The system of claim 1, wherein the second sensor unit comprises:

(a) a processor for processing the second train detection signal received from the second sensor probe and generating the second train indication signal in response thereto;

(b) a sensor interface for interfacing the second train detection signal of the second sensor probe with the processor;

(c) a transmitter for transmitting the second train indication signal; and (d) a power supply for supplying operational power to the second sensor unit.

10. The system of claim 9, wherein the second sensor unit comprises a solar panel array for providing a charge current to the power supply.

11. The system of claim 9, further comprising an antenna connected to the transmitter for transmitting the second train indication signal.

12. The system of claim 1, wherein the crew warning device comprises:

(a) a portable, collapsible light standard capable of being erected on uneven terrain;

(b) an audible warning device mounted on the light standard for providing an audible output signal; and (c) a visual warning device mounted on the light standard for providing a visual output signal.

13. The system of claim 12, wherein the audible warning device comprises a siren horn.

14. The system of claim 12, wherein the visual warning device comprises a strobe light beacon.

15. The system of claim 12, wherein the antenna coupled to the receiver unit is mounted to the light standard.

16. The system of claim 1, further comprising a portable warning device having visual and audible warning mean for warning an individual crew member of the presence of an oncoming train.

* * * * *